US007763405B2

(12) United States Patent
Wu et al.

(10) Patent No.: US 7,763,405 B2
(45) Date of Patent: Jul. 27, 2010

(54) PHOTOCONDUCTORS CONTAINING FLUORINATED COMPONENTS

(75) Inventors: Jin Wu, Webster, NY (US); Ryan J. Ehmann, Penfield, NY (US); Lanhui Zhang, Webster, NY (US); Lin Ma, Webster, NY (US); Liang-Bih Lin, Rochester, NY (US); Daniel V. Levy, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 745 days.

(21) Appl. No.: 11/728,006

(22) Filed: Mar. 23, 2007

(65) Prior Publication Data

US 2008/0233501 A1 Sep. 25, 2008

(51) Int. Cl.
*G03G 5/10* (2006.01)

(52) U.S. Cl. ..... 430/58.8; 430/56; 430/58.75; 430/930

(58) Field of Classification Search ..... 430/56, 430/69, 58.8, 58.75, 930
See application file for complete search history.

(56) References Cited

U.S. PATENT DOCUMENTS

| | | | | |
|---|---|---|---|---|
| 4,265,990 | A | 5/1981 | Stolka et al. | |
| 4,654,284 | A | 3/1987 | Yu et al. | |
| 5,021,309 | A | 6/1991 | Yu | |
| 5,069,993 | A | 12/1991 | Robinette et al. | |
| 5,919,590 | A | 7/1999 | Yu et al. | |
| 6,528,226 | B1 | 3/2003 | Yu et al. | |
| 6,913,863 | B2 | 7/2005 | Wu et al. | |
| 7,037,631 | B2 | 5/2006 | Wu et al. | |
| 7,094,509 | B2 * | 8/2006 | Tong et al. | 430/58.8 |
| 2005/0026058 | A1 * | 2/2005 | Kami et al. | 430/66 |

FOREIGN PATENT DOCUMENTS

JP 02176666 A * 7/1990

OTHER PUBLICATIONS

Jin Wu et al., U.S. Appl. No. 11/593,658 on Photoconductors Containing Halogenated Binders, filed Nov. 7, 2006.
John F. Yanus et al., U.S. Appl. No. 11/593,875 on Silanol Containing Overcoated Photoconductors, filed Nov. 7, 2006.
John F. Yanus et al., U.S. Appl. No. 11/593,657 on Overcoated Photoconductors with Thiophosphate Containing Charge Transport Layers, filed Nov. 7, 2006.
John F. Yanus et al., U.S. Appl. No. 11/593,656 on Silanol Containing Charge Transport Overcoated Photoconductors, filed Nov. 7, 2006.
John F. Yanus et al., U.S. Appl. No. 11/593,662 on Overcoated Photoconductors with Thiophosphate Containing Photogenerating Layer, filed Nov. 7, 2006.

* cited by examiner

*Primary Examiner*—Christopher RoDee
(74) *Attorney, Agent, or Firm*—E. O. Palazzo

(57) ABSTRACT

A photoconductor containing a fluoroalkyl ester layer, a supporting substrate, a photogenerating layer, and at least one charge transport layer.

32 Claims, No Drawings

PHOTOCONDUCTORS CONTAINING FLUORINATED COMPONENTS

CROSS REFERENCE TO RELATED APPLICATIONS

U.S. application Ser. No. 11/728,013, U.S. Publication No. 20080233503, filed Mar. 23, 2007, the disclosure of which is totally incorporated herein by reference, on Photoconductor Fluorinated Charge Transport Layers by Jin Wu et al.

U.S. application Ser. No. 11/728,007, U.S. Publication No. 20080233502, filed Mar. 23, 2007, the disclosure of which is totally incorporated herein by reference, on Overcoated Photoconductors Containing Fluorinated Components by Jin Wu et al.

U.S. application Ser. No. 11/593,875, U.S. Publication No. 20080107985, filed Nov. 7, 2006, the disclosure of which is totally incorporated herein by reference, on Silanol Containing Overcoated Photoconductors by John F. Yanus et al.

U.S. application Ser. No. 11/593,657, U.S. Publication No. 20080107984, filed Nov. 7, 2006, the disclosure of which is totally incorporated herein by reference, on Overcoated Photoconductors with Thiophosphate Containing Charge Transport Layers by John F. Yanus et al.

U.S. application Ser. No. 11/593,656, U.S. Publication No. 20080107979, filed Nov. 7, 2006, the disclosure of which is totally incorporated herein by reference, on Silanol Containing Charge Transport Overcoated Photoconductors by John F. Yanus et al.

U.S. application Ser. No. 11/593,662, U.S. Publication No. 20080107983, filed Nov. 7, 2006, the disclosure of which is totally incorporated herein by reference, on Overcoated Photoconductors With Thiophosphate containing Photogenerating Layer by John F. Yanus.

A number of the components of the above cross-referenced patent applications, such as the supporting substrates, the photogenerating layer pigments and binders, the charge transport layer molecules and binders, the adhesive layer materials, the overcoatings of, for example, the copending applications U.S. application Ser. No. 11/593,875, U.S. application Ser. No. 11/593,657, U.S. application Ser. No. 11/593,656, U.S. application Ser. No. 11/593,662, and the like, may be selected for the photoconductors of the present disclosure in embodiments thereof.

BACKGROUND

This disclosure is generally directed to imaging members, devices, photoreceptors, photoconductors, and the like. More specifically, the present disclosure is directed to rigid or multilayered flexible, belt imaging members, or devices comprised of a supporting medium like a substrate, and which photoconductor contains a fluoroalkyl ester anticurl back coating (ACBC), and more specifically, a layer of a fluoroalkyl ester situated on the reverse side of the photoconductor substrate; a photogenerating layer; an optional undercoat or hole blocking layer usually situated between the substrate and the photogenerating layer, and at least one charge transport layer, wherein at least one is from 1 to about 5, from 1 to about 3, 2, one, and the like, such as a first charge transport layer, and a second charge transport layer, a hole blocking layer, an optional adhesive layer, and an optional overcoating layer, and wherein at least one of the charge transport layers contains at least one charge transport component, and a polymer or resin binder, and where in embodiments the resin binder selected for the hole blocking layer is a known suitable binder including a binder that is substantially insoluble in a number of solvents like methylene chloride, examples of these binders being illustrated in copending application U.S. application Ser. No. 11/593,658, the disclosure of which is totally incorporated herein by reference. Also, in embodiments the present disclosure is directed to photoconductors where a fluoroalkyl ester is incorporated into at least one of the charge transport layers or into an optional overcoating layer and where in embodiments the overcoating layer is free of the ester.

For flexible photoconductive members, to offset undesirable curling thereof, an anticurl back coating is applied to the backside of the flexible substrate support, opposite to the side of the photogenerating layer, that is the anticurl layer is in contact with the reverse side of the substrate resulting in a substantially flat photoconductor member web. Curling of a photoreceptor web is undesirable because, for example, it hinders fabrication of the web into cut sheets and subsequent welding into a belt. An anticurl back coating having a counter curling effect equal to and in the opposite direction to the applied layers is deposited on the reverse side of the active imaging member substrate to eliminate or minimize the overall curl of the coated member by offsetting the curl effect which arises from the mismatch of the thermal contraction coefficient between the substrate and the charge transport layer resulting in greater charge transport layer dimensional shrinkage than that of the substrate.

Although an anticurl back coating is selected to counteract and balance the curl so as to allow the imaging member web to lay flat, nonetheless, common formulations used for anticurl back coatings have in a number of instances been found to provide unsatisfying dynamic imaging member belt performance under normal machine functioning conditions; for example, exhibition of excessive anticurl back coating wear and its propensity to cause electrostatic charge buildup are the frequently seen problems that prematurely reduce the service life of the photoreceptor belt and require its frequent costly replacement in the field.

Moreover, high surface contact friction of the anticurl back coating against all these machine subsystems can cause the development of electrostatic charge buildups. In a number of xerographic machines, the electrostatic charge builds up due to the high contact friction between the anticurl back coating and the backer bars which increases the frictional force to the point that it requires higher torque from the driving motor to pull the belt for effective cycling motion. In full color electrophotographic machines using a 10-pitch photoreceptor belt, the electrostatic charge build-up can be extremely high due to the large number of backer bars used in the machine.

In an effort to resolve the problems associated with a number of anticurl back coatings, one known wear resistance anticurl back coating formulated for use in the printing apparatuses includes organic reinforcement particles such as a polytetrafluoroethylene (PTFE) dispersion contained in the anticurl back coating polymer binder. PTFE particles are commonly incorporated to reduce the friction between the anticurl back coating of the belt and the backer bars. The benefit of using this formulation may, however, be outweighed by the instability of the PTFE particle dispersion in the anticurl back coating solution. PTFE, being two times heavier than most coating solutions selected, forms an unstable dispersion in a polymer coating solution, commonly a bisphenol A polycarbonate polymer solution, and tends to settle where particles flocculate themselves into large agglomerates in the mix tanks if not continuously stirred. The difficulty of achieving good PTFE dispersion in a coating solution can be a problem since inorganic dispersion can result in an anticurl back coating with insufficient and variable or inhomogeneous dispersions along the length of the coated web, and thus, a substantially inadequate reduction of friction over the backer bars contained in a copier or printer. This can cause complications for larger copiers or printers, which often include many backer bars, where the high friction increases the torque needed to drive the belt. Consequently, two driving rollers are included and synchronized to substantially prevent any registration error from occurring. The additional components, such as the two driving rollers result in high costs for producing and using these larger printing apparatuses. Thus, if the friction could be reduced, the apparatus design in these larger printing apparatuses could be simplified with less components resulting in a substantial cost savings.

Examples of anticurl back coating formulations are disclosed in U.S. Pat. Nos. 5,069,993; 5,021,309; 5,919,590; 4,654,284 and 6,528,226. However, while these formulations serve their intended purposes, further improvement on those formulations is desirable and needed. More particularly, there is a need, which is addressed herein, to create an anticurl back coating formulation that has intrinsic properties to minimize or eliminate charge accumulation in photoreceptors without sacrificing the other electrical properties such as low surface energy.

Photoconductors containing fluorinated polymers, such as polyvinylidene fluoride (PVDF), and polytetrafluoroethylene (PTFE), in the ACBC layer can be difficult to prepare, and uniform and stable dispersions thereof usually cannot be obtained; the ACBC layer containing a fluoropolymer tends to charge up triboelectrically due to the rubbing of this layer against, for example, backer plates and rollers in, for example, a printing machine, resulting in electrostatic drag force that adversely affects the process speed of a photoconductor present in the machine; fluoropolymer particles or debris adversely affect other related systems in the machine; and there can be charge accumulation on the ACBC surface resulting from, for example, the bulk conductivity of the ACBC. Low surface energy charge transport layers are desirable for photoconductors to permit excellent wear resistance characteristics, emulsion aggregation toner cleanability, and anti-filming properties, all of which are not readily achievable with the incorporation of fluoropolymers in the charge transport layer. Also, for flexible belt photoconductors is the unwanted LCM that is generated from fluoropolymer (PTFE/surfactant dopants) since unlike in drum P/R, the charge transport layer degrades or wears from blade cleaning in belt photoconductors, thus conductive species tend to accumulate on the surface resulting in LCM. These and other disadvantages are avoided or minimized with the photoconductors of the present disclosure that contain a fluoroalkyl ester in the ACBC and/or the charge transport layer or optional overcoating layer.

Also included within the scope of the present disclosure are methods of imaging and printing with the photoconductors illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the photoconductor is to be used in a printing mode, the imaging method involves the same operation with the exception that exposure can be accomplished with a laser device or image bar. More specifically, the flexible photoconductor belts disclosed herein can be selected for the Xerox Corporation iGEN® machines that generate with some versions over 100 copies per minute. Processes of imaging, especially xerographic imaging and printing, including digital, and/or color printing, are thus encompassed by the present disclosure.

The photoreceptors illustrated herein, in embodiments, have extended lifetimes; possess excellent, and in a number of instances low $V_r$ (residual potential); and allow the substantial prevention of V, cycle up when appropriate; high sensitivity; low acceptable image ghosting characteristics; and desirable toner cleanability.

REFERENCES

Photoconductors with a charge transport layer, an optional protective top overcoating layer or an ACBC layer containing a fluoropolymer are known, however, a number of disadvantages are associated with these photoconductors as illustrated herein.

There is illustrated in U.S. Pat. No. 7,037,631, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoconductors have been described in a number of U.S. patents, such as U.S. Pat. No. 4,265,990, the disclosure of which is totally incorporated herein by reference, wherein there is illustrated an imaging member comprised of a photogenerating layer, and an aryl amine hole transport layer, and which layers can include a number of resin binders. Examples of photogenerating layer components disclosed in the U.S. Pat. No. 4,265,990 include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound and an amine hole transport dispersed in an electrically insulating organic resin binder.

Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468, wherein there is illustrated a hole blocking layer of titanium dioxide dispersed in a specific linear phenolic binder of VARCUM™, available from OxyChem Company.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments, which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components, and processes of the above-recited patents may be selected for the present disclosure in embodiments thereof. More specifically, a number of the components and amounts thereof of the above patents, such as the supporting substrates, resin binders and charge transport molecules for the charge transport layer, photogenerating layer components like hydroxygallium phthalocyanines (OHGaPc), antioxidants, hole blocking layer components, adhesive layers, and the like, may be selected for the members of the present disclosure in embodiments thereof.

SUMMARY

Disclosed are imaging members with many of the advantages illustrated herein, such as low surface energy ACBC layers and low surface energy charge transport layers or optional overcoating layers; and also extended lifetimes of service of, for example, about 2,000,000 imaging cycles; excellent electronic characteristics; stable electrical properties; low image ghosting; resistance to charge transport layer cracking upon exposure to the vapor of certain solvents; consistent $V_r$ (residual potential) that is substantially flat or no change over a number of imaging cycles as illustrated by the generation of known PIDC (Photo-Induced Discharge Curve), and the like.

Further disclosed are drum and layered flexible photoconductive members with sensitivity to visible light.

Moreover, disclosed are layered belt photoresponsive or photoconductive imaging members with mechanically robust and solvent resistant charge transport layers.

EMBODIMENTS

Aspects of the present disclosure relate to a photoconductor comprising a fluoroalkyl ester containing anticurl back coating layer in contact with a supporting substrate, thereover a supporting substrate, a photogenerating layer comprised of a photogenerating component optionally dispersed in a resin or polymer binder, and at least one charge transport layer, such as from 1 to about 7 layers, from 1 to about 5 layers, from 1 to about 3 layers, 2 layers, or 1 layer; a flexible photoconductor comprising in sequence a supporting substrate, a photogenerating layer and at least one fluoroalkyl ester charge transport layer comprised of at least one charge transport component comprised of hole transport molecules and a resin binder, and an optional hole blocking layer comprised, for example, of an aminosilane and a halogenated, such as a chlorinated, polymeric resin that is insoluble or substantially insoluble in methylene chloride, and a number of other similar solvents; a photoconductive member containing a fluoroalkyl ester in the ACBC layer or in at least one charge transport layer, and with a photogenerating layer of a thickness of from about 0.1 to about 10 microns, at least one transport layer each of a thickness of from about 5 to about 100 microns; an imaging method and an imaging apparatus containing a charging component, a development component, a transfer component, and a fixing component, and wherein the apparatus contains a photoconductive imaging member as illustrated herein; a member wherein the photogenerating layer contains a binder like a polycarbonate; a member wherein the thickness of the photogenerating layer is from about 0.1 to about 4 microns; a member wherein the hole blocking layer polymer binder is present in an amount of from about 0.1 to about 90, from 1 to about 50, from 2 to about 25, from 5 to about 10 percent by weight, and wherein the total of all blocking layer components is about 100 percent; a member wherein the photogenerating component is a hydroxygallium phthalocyanine that absorbs light of a wavelength of from about 370 to about 950 nanometers; an imaging member or photoconductor wherein the supporting substrate is comprised of a conductive substrate comprised of a metal; an imaging member wherein the conductive substrate is aluminum, aluminized polyethylene terephthalate or titanized polyethylene terephthalate; a photoconductor or an imaging member wherein the photogenerating pigment is a metal free phthalocyanine; an imaging member (or photoconductor) wherein each of the charge transport layers comprises

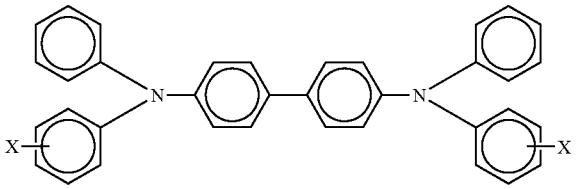

wherein X is selected from the group consisting of a suitable hydrocarbon like alkyl, alkoxy, aryl, and substituted derivatives thereof; halogen, and mixtures thereof, or wherein X can be included on the four terminating rings; an imaging member wherein alkyl and alkoxy contains from about 1 to about 12 carbon atoms; an imaging member wherein alkyl contains from about 1 to about 5 carbon atoms; an imaging member wherein alkyl is methyl; an imaging member wherein each of or at least one of the charge transport layers comprises

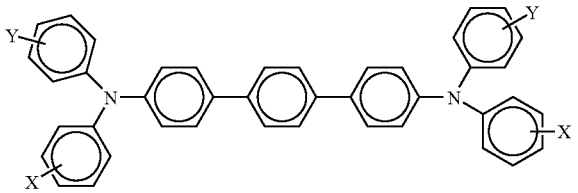

wherein X and Y are independently alkyl, alkoxy, aryl, a halogen, or mixtures thereof; an imaging member wherein for the above terphenyl amine alkyl and alkoxy each contains from about 1 to about 12 carbon atoms; an imaging member wherein alkyl contains from about 1 to about 5 carbon atoms; an imaging member wherein the photogenerating pigment present in the photogenerating layer is comprised of chlorogallium phthalocyanine, titanyl phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member or photoconductor wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; a method of imaging which comprises generating an electrostatic latent image on an imaging member, developing the latent image, and transferring the developed electrostatic image to a suitable substrate; a method of imaging wherein the imaging member is exposed to light of a wavelength of from about 370 to about 950 nanometers; a member wherein the photogenerating layer is situated between the substrate and the charge transport; a member wherein the charge transport layer is situated between the substrate and the photogenerating layer; a member wherein the photogenerating layer is of a thickness of from about 0.1 to about 50 microns; a member wherein the photogenerating component amount is from about 0.05 weight percent to about 95 weight percent, and wherein the photogenerating pigment is dispersed in from about 96 weight percent to about 5 weight percent of polymer binder, and where the hole blocking layer contains a chlorinated polymer binder; a member wherein the thickness of the photogenerating layer is from about 0.2 to about 12 microns; an imaging member wherein the charge transport layer resinous binder is selected from the group consisting of polyesters, polyvinyl butyrals, polycarbonates, polyarylates, copolymers of polycarbonates and polysiloxanes, polystyrene-b-polyvinyl pyridine, and polyvinyl formals; an imaging member wherein the photogenerating component is Type V hydroxygallium phthalocyanine, titanyl phthalocyanine or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules; an imaging member wherein the photogenerating layer contains an alkoxygallium phthalocyanine; a photoconductive imaging member with an aminosilane and chlorinated polymer containing blocking layer contained as a coating on a substrate, and an adhesive layer coated on the blocking layer; a color method of imaging which comprises generating an electrostatic latent image on the imaging member, developing the latent image, transferring, and fixing the developed electrostatic image to a suitable substrate; photoconductive imaging members comprised of a supporting substrate and thereunder the fluoroalkyl ester ACBC illustrated herein, a hole blocking or undercoat layer as illustrated herein, a photogenerating layer, a hole transport layer, and a top overcoating layer in contact with the hole transport layer, or in embodiments, in contact with the photogenerating layer, and in embodiments wherein a plurality of charge transport layers are selected, such as for example, from 2 to about 10, and more specifically, 2 may be selected; and a photoconductive imaging member comprised in sequence of a fluoroalkyl ester containing ACBC; a supporting substrate; a hole blocking layer; a photogenerating layer comprised of a photogenerating pigment and a first, second, or third charge transport layer; a photoconductor comprising in sequence a substrate, a hole blocking or undercoat layer, a photogenerating pigment layer and a charge transport layer, which optionally contains a fluoroalkyl ester, and which layer is also comprised of at least one charge transport component, and a resin binder; a photoconductor comprising a layer comprised of a polymer and a fluoroalkyl ester; thereover a supporting substrate, a photogenerating layer, and at least one charge transport layer; a photoconductor wherein the fluoroalkyl ester layer is an anticurl back coating layer; a photoconductor wherein the fluoroalkyl ester results from the esterification product of a fluoroalcohol and a carboxylic acid; a photoconductor wherein the photogenerating layer is comprised of at least one, such as from 1 to about 4, photogenerating pigment or pigments, and a polymer binder; a photoconductor wherein the carboxylic acid is at least one of a monobasic acid and a polybasic acid, each with, for example, from about 2 to about 48 carbon atoms, and more specifically, from about 10 to about 25 carbon atoms; a photoconductor wherein the carboxylic acid is selected from a group consisting of acetic acid, octanoic acid, lauric acid, stearic acid, maleic acid, adipic acid, azelic acid, dodecanediacid, citric acid and mixtures thereof; a photoconductor wherein the fluoroalcohol is

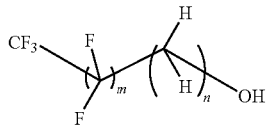

wherein m is from about 1 to about 18, from about 2 to about 12, and more specifically, from about 2 to about 4, and n is from about 1 to about 10, from 1 to about 7, and more specifically, from 1 to about 5; a photoconductor wherein the ACBC fluoroalkyl ester is selected, for example, from the group consisting of fluoroalkyl acetate, fluoroalkyl octanoate, fluoroalkyl laurate, fluoroalkyl stearate, fluoroalkyl malonate, fluoroalkyl adipate, fluoroalkyl azelate, fluoroalkyl dodecanedioate, fluoroalkyl citrate, and mixtures thereof; a photoconductor wherein the charge transport layer is comprised of at least one of

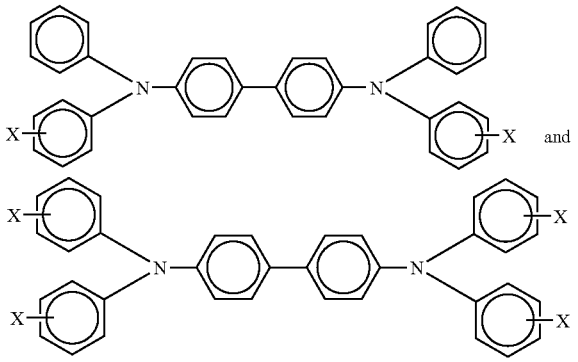

and wherein X is a suitable hydrocarbon, and more specifically, is selected from the group consisting of at least one of alkyl, alkoxy, aryl, and halogen; and a photoconductor wherein the charge transport layer is comprised of at least one of

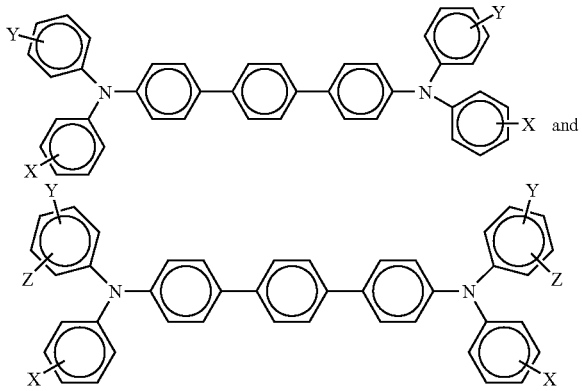

and wherein each X, Y and Z is a suitable hydrocarbon, and more specifically, is independently selected from the group consisting of alkyl, alkoxy, aryl, halogen, and mixtures thereof; and wherein at least one of Y and Z are present; a photoconductor comprising an optional supporting substrate, a photogenerating layer, and at least one fluoroalkyl ester containing charge transport layer; and a photoconductor comprising an optional supporting substrate, a photogenerating layer, at least one charge transport layer, and an overcoating layer in contact with and contiguous to said charge transport layer, and which overcoating is comprised of a fluoroalkyl ester, and a polymer.

Fluoroalkyl esters selected for the ACBC layer, the charge transport layer, the optional overcoating layer, or both the ACBC and charge transport layer are esterification products of a fluoroalcohol and a carboxylic acid, which acid can be a monobasic or polybasic acid with, for example, from about 2 to about 48, or from about 4 to about 30 carbon atoms. Examples of the carboxylic acids include monobasic carboxylic acids, such as acetic acid, octanoic acid, lauric acid, stearic acid, and the like; dibasic carboxylic acids, such as maleic acid, adipic acid, azelic acid, dodecanediacid, and the like; and tribasic acids, such as citric acid, and the like.

Examples of the fluoroalcohols can be generically represented by

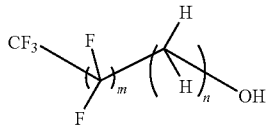

wherein m and n represent the number of repeating units, and more specifically, wherein m is from about 1 to about 18, or from about 3 to about 10; n is from about 1 to about 10, or from about 2 to about 4; or n is 2.

Examples of fluoroalkyl esters include fluoroalkyl monoesters, which can be represented by the following formula

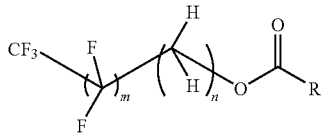

wherein m and n represent the number of repeating units, and more specifically, wherein m is from about 1 to about 18, or from about 3 to about 10; n is from about 1 to about 10, or from about 2 to about 4; or n is 2; R is alkyl with, for example, from about 2 to about 30, from 2 to about 15, from 2 to about 10, from 1 to about 20 carbon atoms. Specific examples of fluoroalkyl monoesters can be selected from the group consisting of at least one of a fluoroalkyl acetate, fluoroalkyl octanoate, fluoroalkyl laurate, fluoroalkyl stearate, and the like, and mixtures thereof. Commercially available fluoroalkyl monoesters include ZONYL® FTS (a fluoroalkyl stearate with average molecular weight of 703), ZONYL® TM (a fluoroalkyl methacrylate with average molecular weight of 534), ZONYL® TA-N (a fluoroalkyl acrylate with, for example, a weight average molecular weight of 569), all available from E.I. DuPont.

Examples of fluoroalkyl esters further include fluoroalkyl diesters such as fluoroalkyl malonate, fluoroalkyl adipate, fluoroalkyl azelate, fluoroalkyl dodecanedioate, and the like, and mixtures thereof; fluoroalkyl triesters such as fluoroalkyl citrate; commercially available fluoroalkyl monoesters like ZONYL® TBC (a fluoroalkyl citrate with a weight average molecular weight of 1,563) available from E.I. DuPont.

In embodiments, the fluoroalkyl esters are incorporated into conventional photoreceptor surface layers, namely, the anticurl back coating layer, the charge transport layers and/or optionally the overcoating layer. The coating formulation may, but need not, include PTFE, silica or other like conventional particles selected primarily to improve the mechanical properties of this layer. These conventional particles are present, for example, in an amount of from about 1 to about 20, or from about 4 to about 10 weight percent of the ACBC layer components. The anticurl back coating layer further comprises at least one polymer, which usually is the same polymer as selected for the charge transport layers. Examples of these polymers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, the polymeric binders are comprised of polycarbonate resins with a weight average molecular weight of from about 20,000 to about 100,000, and more specifically, with a molecular weight $M_w$ of from about 50,000 to about 100,000. In various embodiments, the anticurl back coating layer has a thickness of from about 1 to about 100, from about 5 to about 50, and more specifically, from about 10 to about 30 microns.

The fluoroalkyl ester in embodiments can be physically mixed, dissolved or dispersed into the surface layer coating solutions or dispersions such as the anticurl back coating layer components, the charge transport layers or optionally the overcoating layer used to form the eventual surface layers in the imaging member. The fluoroalkyl ester is present in various effective suitable amounts, such as for example, from about 0.01 to about 10, from about 0.1 to about 5, and more specifically, from about 0.5 to about 2 weight percent of the photoconductor layers like the anticurl back coating layer, the charge transport layers, and/or the overcoating layer.

The thickness of the photoconductor substrate layer depends on a number of factors, including economical considerations, electrical characteristics, and the like, thus this layer may be of a thickness, for example, of over 3,000 microns, such as from about 1,000 to about 3,300 microns, from about 1,000 to about 2,000 microns, from about 500 to about 1,200 microns, or from about 300 to about 700 microns, or of a minimum thickness. In embodiments, the thickness of this layer is from about 75 microns to about 300 microns, or from about 100 to about 150 microns.

The substrate may be comprised of a number of known substances and can be opaque or substantially transparent, and may comprise any suitable material that functions as a supporting layer for the hole blocking, adhesive, photogenerating, and charge transport layers, and which substrate should possess the appropriate mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum photoconductor, this layer may be of a substantial thickness of, for example, up to many centimeters or of a minimum thickness of less than a millimeter. Similarly, a flexible belt may be of substantial thickness of, for example, about 250 micrometers, or of a minimum thickness of equal to or less than about 50 micrometers, such as from about 5 to about 45, from about 10 to about 40, from about 1 to about 25, or from about 3 to about 45 micrometers. In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent, comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The photogenerating layer in embodiments is comprised of a number of known photogenerating pigments, such as for example, metal phthalocyanines, Type V hydroxygallium phthalocyanine or chlorogallium phthalocyanines usually dispersed in a resin binder. Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 micron to about 10 microns, and more specifically, from about 0.25 micron to about 4 microns when, for example, the photogenerating compositions are present in an amount of from about 30 to about 75 percent by volume. The maximum thickness of this layer in embodiments is dependent primarily upon factors, such as photosensitivity, electrical properties, and mechanical considerations.

Photogenerating layer examples may comprise amorphous films of selenium and alloys of selenium and arsenic, tellurium, germanium and the like, hydrogenated amorphous silicon and compounds of silicon and germanium, carbon, oxygen, nitrogen, and the like fabricated by vacuum evaporation or deposition. The photogenerating layers may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder and fabricated by solvent coating techniques.

Various suitable and conventional known processes may be used to mix, and thereafter, apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The coating of the photogenerating layer in embodiments of the present disclosure can be accomplished such that the final dry thickness of the photogenerating layer is as illustrated herein, and can be, for example, from about 0.01 to about 30 microns after being dried at, for example, about 40° C. to about 150° C. for about 1 to about 90 minutes. More specifically, a photogenerating layer of a thickness, for example, of from about 0.1 to about 30, or from about 0.2 to about 5 microns can be applied to or deposited on the substrate, on other surfaces in between the substrate and the charge transport layer, and the like.

For the deposition of the photogenerating layer, it is desirable to select a coating solvent that may not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

A number of suitable known charge transport components, molecules, or compounds can be selected for the charge transport layer, which layer is generally of a thickness of from about 5 microns to about 90 microns, and more specifically, of a thickness of from about 10 microns to about 40 microns, such as aryl amines of the following formula/structure

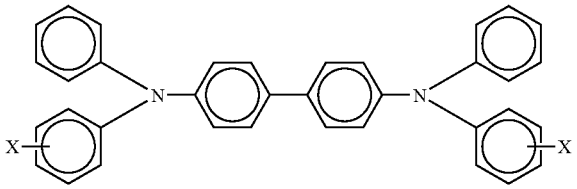

wherein X, which X may also be contained on each of the four terminating rings, is a suitable hydrocarbon such as alkyl, alkoxy, aryl, derivatives thereof, or mixtures thereof; and a halogen, or mixtures of the hydrocarbon and halogen, and especially those substituents selected from the group consisting of $C_1$ and $CH_3$; and molecules of the following formula

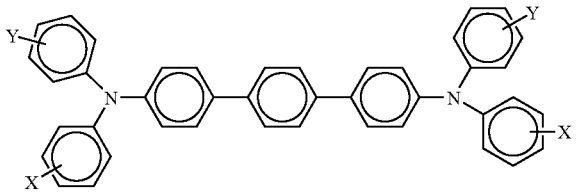

wherein X and Y are independently alkyl, alkoxy, aryl, a halogen, or mixtures thereof.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines present in an amount of from about 20 to about 90 weight percent include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000 preferred. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, "charge transport" refers, for example, to charge transporting molecules as a monomer that allows the free charge generated in the photogenerating layer to be transported across the transport layer.

Examples of hole transporting molecules, especially for the first and second charge transport layers, and present in an amount of from about 35 to about 90 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments, to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropyl phenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material or a combination of a small molecule charge transport material and a polymeric charge transport material.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is from about 10 to about 70 micrometers, but thicknesses outside this range may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to about 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer.

The thickness of the continuous charge transport overcoat layer selected depends upon the abrasiveness of the charging (bias charging roll), cleaning (blade or web), development (brush), transfer (bias transfer roll), and the like in the system employed, and can be up to about 10 microns. In embodiments, this thickness for each layer is from about 1 micron to about 5 microns. Various suitable and conventional methods may be used to mix, and thereafter apply the charge transport layer and an overcoat layer coating mixture to the photogenerating layer. Typical application techniques include spraying, dip coating, and roll coating, wire wound rod coating, and the like. Drying of the deposited coating may be effected by any suitable conventional technique, such as oven drying, infrared radiation drying, air drying, and the like. The dried overcoating layer of this disclosure can in embodiments transport holes during imaging, and should not have too high a free carrier concentration. Free carrier concentration in the overcoat increases the dark decay. Examples of overcoatings, such as PASCO, are illustrated in copending applications, the disclosures of which are totally incorporated herein by reference.

The optional hole blocking or undercoat layer for the imaging members of the present disclosure can contain a number of components as illustrated herein, including known hole blocking components, such as amino silanes, doped metal oxides, TiSi, a metal oxide like titanium, chromium, zinc, tin, and the like; a mixture of phenolic compounds and a phenolic resin, or a mixture of two phenolic resins; and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylenediisopropylidene) bisphenol), S (4,4'-sulfonyldiphenol), Z (4,4'-cyclohexylidenebisphenol); hexafluorobisphenol A (4,4'-(hexafluoro isopropylidene)diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion, a phenolic compound and dopant are added followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM® 29159 and 29101 (available from OxyChem Company), and DURITE® 97 (available from Borden Chemical), formaldehyde polymers with ammonia, cresol and phenol, such as VARCUM® 29112 (available from OxyChem Company), formaldehyde polymers with 4,4'-(1-methylethylidene) bisphenol, such as VARCUM™ 29108 and 29116 (available from OxyChem Company), formaldehyde polymers with cresol and phenol, such as VARCUM® 29457 (available from OxyChem Company), DURITE® SD-423A, SD-422A (available from Borden Chemical), or formaldehyde polymers with phenol and p-tert-butylphenol, such as DURITE® ESD 556C (available from Borden Chemical).

The optional hole blocking layer may be applied to the top substrate surface in contact with the photogenerating layer. Any suitable and conventional blocking layer capable of forming an electronic barrier to holes between the adjacent photoconductive layer (or electrophotographic imaging layer) and the underlying conductive surface of the substrate may be selected.

Hole blocking layer components can comprise an aminosilane such as 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy) silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino)ethylamino]-3-proprionate, (N,N'-dimethyl 3-amino)propyl triethoxysilane, N,N-dimethylaminophenyl triethoxysilane, trimethoxysilylpropyldiethylene triamine, and the like, and mixtures thereof. Specific aminosilane materials are 3-aminopropyl triethoxysilane (γ-APS), N-aminoethyl-3-aminopropyl trimethoxysilane, (N,N'-dimethyl-3-amino)propyl triethoxysilane, and mixtures thereof.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA™ STAB AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

Primarily for purposes of brevity, the examples of each of the substituents and each of the components/compounds/molecules, polymers, (components) for each of the layers, specifically disclosed herein are not intended to be exhaustive. Thus, a number of suitable components, polymers, formulas, structures, and R groups or substituent examples and carbon chain lengths not specifically disclosed or claimed are intended to be encompassed by the present disclosure and claims. For example, these substituents include suitable known groups, such as aliphatic and aromatic hydrocarbons with various carbon chain lengths, and which hydrocarbons can be substituted with a number of suitable known groups and mixtures thereof. Also, the carbon chain lengths are intended to include all numbers between those disclosed or claimed or envisioned, thus from 1 to about 12 carbon atoms, includes 1, 2, 3, 4, 5, 6, 7, 8, 9, 10, 11, and 12, up to 25, or more. Similarly, the thickness of each of the layers, the examples of components in each of the layers, the amount ranges of each of the components disclosed and claimed is not exhaustive, and it is intended that the present disclosure and claims encompass other suitable parameters not disclosed, or that may be envisioned.

The following Examples are being submitted to illustrate embodiments of the present disclosure. Comparative data is also presented. These Examples are intended to be illustrative only, and are not intended to limit the scope of the present disclosure. Also, parts and percentages are by weight unless otherwise indicated.

COMPARATIVE EXAMPLE 1

A controlled anticurl back coating solution was prepared by introducing into an amber glass bottle in a weight ratio of 0.08:0.92 VITEL® 2200 a copolyester of iso/terephthalic acid, dimethylpropanediol and ethanediol having a melting point of from about 302° C. to about 320° C., commercially available from Shell Oil Company, Houston, Tex., and MAKROLON® 5705, a known polycarbonate resin having a weight average molecular weight of from about 50,000 to about 100,000, commercially available from Farbenfabriken Bayer A.G. The resulting mixture was then dissolved in methylene chloride to form a solution containing 9 percent by weight solids. This solution was applied on the back of the photoconductor supporting substrate comprised of a biaxially oriented polyethylene naphthalate substrate (KALEDEX™ 2000) having a thickness of 3.5 mils to form a coating of the anticurl back coating layer that upon drying (120° C. for 1 minute) had a thickness of 17.4 microns. During this coating process the humidity was equal to or less than 15 percent, and thereover the above substrate a 0.02 micron thick titanium layer coated (the coater device) on a biaxially oriented polyethylene naphthalate substrate (KALEDEX™ 2000) having a thickness of 3.5 mils, and applying thereon, with a gravure applicator, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in the forced air dryer of the coater. The resulting hole blocking layer had a dry thickness of 500 Angstroms. An adhesive layer was then prepared by applying a wet coating over the blocking layer, using a gravure applicator, and which adhesive contained 0.2 percent by weight, based on the total weight of the solution, of copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer of the coater. The resulting adhesive layer had a dry thickness of 200 Angstroms.

A photogenerating layer dispersion was prepared by introducing 0.45 gram of the known polycarbonate IUPILON 200™ (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.4 micron.

The resulting member web was then overcoated with two charge transport layers. Specifically, the photogenerating layer was overcoated with a charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine, and MAKROLON 5705®, a known polycarbonate resin having a molecular weight average of from about 50,000 to 100,000, commercially available from Farbenfabriken Bayer A.G. The resulting mixture was then dissolved in methylene chloride to form a solution containing 15 percent by weight solids. This solution was applied on the photogenerating layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top layer. The charge transport layer solution of the top layer was prepared as described above for the bottom layer. This solution was applied on the bottom layer of the charge transport layer to form a coating that upon drying (120° C. for 1 minute) had a thickness of 14.5 microns. During this coating process the humidity was equal to or less than 15 percent.

EXAMPLE I

A photoconductor was prepared by repeating the process of Comparative Example 1 except that there was added to the ACBC layer 1 percent by weight of the fluoroalkyl ester ZONYL® FTS, a fluoroalkyl stearate, available from E.I. DuPont, a tan solid with a weight average molecular weight of about 703, and containing 46.7 percent fluorine.

EXAMPLE II

A photoconductor was prepared by repeating the process of Comparative Example 1 except that there was added to the ACBC layer (anticurl layer) 2 percent by weight of the fluoroalkyl ester ZONYL® FTS, a fluoroalkyl stearate, available from E.I. DuPont, a tan solid with a weight average molecular weight of about 703, and containing 46.7 percent fluorine.

EXAMPLE III

A photoconductor was prepared by repeating the process of Comparative Example 1 except that there was added to the ACBC layer 5 percent by weight of the fluoroalkyl ester ZONYL®, a fluoroalkyl methacrylate, available from E.I. DuPont, a yellow semi-solid with a weight average molecular weight of about 534, and containing 60.4 percent fluorine.

Contact Angle Measurement

The photoconductor advancing contact angles of water were measured at ambient temperature (~23° C.) using Contact Angle System OCA (Dataphysics Instruments GmbH, model OCA15). Deionized water was used. At least ten measurements were performed and their averages are reported in Table 1 for the photoconductors of Comparative Example 1, Examples I and II.

TABLE 1

| ACBC LAYER | CONTACT ANGLE |
|---|---|
| Comparative Example 1 | 81.9° |
| Example I | 123.1° |
| Example II | 123.6° |

Thus, incorporation of a fluoroalkyl ester into the Example I and Example II ACBC layer increased the contact angle of this layer, which indicated that the surface energy of the layer was lowered.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a layer comprised of a polymer and a fluoroalkyl ester; thereover a supporting substrate, a photogenerating layer, and at least one charge transport layer.

2. A photoconductor in accordance with claim 1 wherein said fluoroalkyl ester layer is an anticurl back coating layer.

3. A photoconductor in accordance with claim 1 wherein said fluoroalkyl ester results from the esterification product of a fluoroalcohol, and a carboxylic acid.

4. A photoconductor in accordance with claim 1 wherein said photogenerating layer is comprised of at least one photogenerating pigment, and a polymer binder.

5. A photoconductor in accordance with claim 3 wherein said carboxylic acid is at least one of a monobasic acid and a polybasic acid, each with from about 2 to about 48 carbon atoms.

6. A photoconductor in accordance with claim 3 wherein said carboxylic acid is selected from a group consisting of acetic acid, octanoic acid, lauric acid, stearic acid, maleic acid, adipic acid, azelic acid, dodecanediacid, citric acid, and mixtures thereof.

7. A photoconductor in accordance with claim 3 wherein said fluoroalcohol is

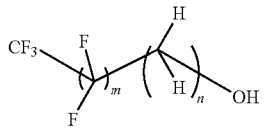

wherein m is from about 1 to about 18, and n is from about 1 to about 10.

8. A photoconductor in accordance with claim 7 wherein m is from about 3 to about 10, and n is from about 2 to about 4.

9. A photoconductor in accordance with claim 1 wherein said ester is selected from a group consisting of fluoroalkyl acetate, fluoroalkyl octanoate, fluoroalkyl laurate, fluoroalkyl stearate, fluoroalkyl malonate, fluoroalkyl adipate, fluoroalkyl azelate, fluoroalkyl dodecanedioate, fluoroalkyl citrate and mixtures thereof.

10. A photoconductor in accordance with claim 1 wherein said ester is present in an amount of from about 0.01 to about 20 weight percent.

11. A photoconductor in accordance with claim 1 wherein said ester is present in an amount of from 0.1 to about 5 weight percent.

12. A photoconductor in accordance with claim 1 wherein said ester possesses a weight average molecular weight of from about 200 to about 2,000, and contains from about 30 to about 80 weight percent of fluorine.

13. A photoconductor in accordance with claim 1 wherein said charge transport layer is comprised of at least one of

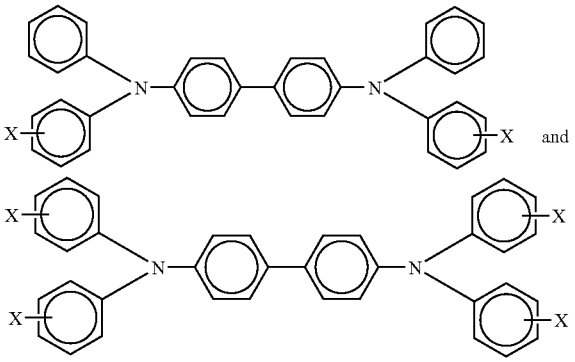

wherein X is selected from the group consisting of at least one of alkyl, alkoxy, aryl, and halogen.

14. A photoconductor in accordance with claim 13 wherein alkyl and alkoxy each contain from about 1 to about 10 carbon atoms, and aryl contains from about 6 to about 42 carbon atoms.

15. A photoconductor in accordance with claim 13 wherein said aryl amine is N,N'-diphenyl-N,N-bis(3-methylphenyl)-1,1'-biphenyl-4,4'-diamine.

16. A photoconductor in accordance with claim 1 wherein said charge transport layer is comprised of at least one of

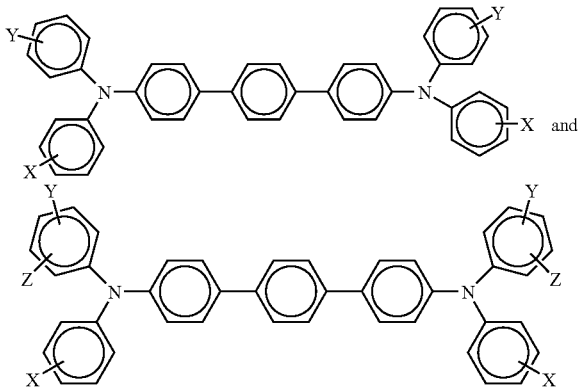

wherein each X, Y and Z is independently selected from the group consisting of alkyl, alkoxy, aryl, and halogen; and mixtures thereof.

17. A photoconductor in accordance with claim 16 wherein each alkoxy and alkyl contains from about 1 to about 10 carbon atoms; aryl contains from 6 to about 36 carbon atoms; and halogen is chloride, bromide, fluoride, or iodide.

18. A photoconductor in accordance with claim 1 wherein said charge transport layer is comprised of at least one of N,N'-bis(4butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethy-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and mixtures thereof.

19. A photoconductor in accordance with claim 1 wherein said at least one charge transport layer contains an antioxidant comprised of a hindered phenol, a hindered amine, or mixtures thereof.

20. A photoconductor in accordance with claim 1 wherein said at least one charge transport layer is from 1 to about 7 layers.

21. A photoconductor in accordance with claim 1 wherein said at least one charge transport layer is from 2 to about 3 layers.

22. A photoconductor in accordance with claim 1 wherein said at least one charge transport layer is comprised of a top charge transport layer and a bottom charge transport layer, and wherein said bottom layer is situated between said photogenerating layer and said top layer.

23. A photoconductor in accordance with claim 1 wherein said photogenerating pigment is comprised of at least one of a chlorogallium phthalocyanine, a titanyl phthalocyanine, a halogallium phthalocyanine, a perylene, and mixtures thereof.

24. A photoconductor in accordance with claim 1 wherein said photogenerating pigment is comprised of a hydroxygallium phthalocyanine, and said substrate is comprised of a conductive substance.

25. A photoconductor in accordance with claim 1 wherein said ester contains from about 45 to about 47 percent fluorine, possesses a weight average molecular weight of from about 700 to about 770, and is present in an amount of from about 1 to about 5 weight percent.

26. A photoconductor in accordance with claim 1 further including a hole blocking layer and an adhesive layer.

27. A flexible photoconductor comprising in sequence a fluoroalkyl ester containing an anticurl layer, a supporting substrate layer, a photogenerating layer, at least one charge transport layer comprised of at least one charge transport component, and a resin binder.

28. A photoconductor in accordance with claim 27 wherein at least one charge transport layer is comprised of from 1 to 3 layers.

29. A photoconductor in accordance with claim 27 wherein at least one charge transport layer is comprised of two layers, a bottom layer in contact with and contiguous to said photogenerating layer, and a top layer charge transport layer contiguous to and in contact with the bottom charge transport layer, and wherein the fluoroalkyl ester layer is situated on the bottom of said substrate.

30. A photoconductor in accordance with claim 27 wherein said ester is the fluoroalkyl monoester

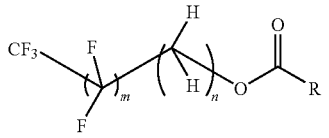

wherein m and n represent the number of repeating units, and wherein m is from about 1 to about 18, and n is from about 1 to about 10, and R is alkyl.

31. A photoconductor comprising in sequence a fluoroalkyl ester layer, a supporting substrate thereover, a photogenerating layer comprised of at least one photogenerating pigment, and a charge transport layer.

32. A photoconductor in accordance with claim 31 wherein said ester is a fluoroalkyl stearate.

* * * * *